US010731350B1

(12) United States Patent
Yang

(10) Patent No.: US 10,731,350 B1
(45) Date of Patent: Aug. 4, 2020

(54) PAVER LOCKDOWN SYSTEMS AGAINST WIND UPLIFT THAT WORK WITH REGULAR PEDESTALS

(71) Applicant: Yongzhi Yang, Anaheim, CA (US)

(72) Inventor: Yongzhi Yang, Anaheim, CA (US)

( * ) Notice: Subject to any disclaimer, the term of this patent is extended or adjusted under 35 U.S.C. 154(b) by 0 days.

(21) Appl. No.: 16/278,332

(22) Filed: Feb. 18, 2019

(51) Int. Cl.
*E04D 13/12* (2006.01)
*E04D 11/00* (2006.01)
*E04F 15/02* (2006.01)
*E04F 15/024* (2006.01)

(52) U.S. Cl.
CPC ..... *E04D 13/12* (2013.01); *E04D 11/005* (2013.01); *E04F 15/02044* (2013.01); *E04F 15/02183* (2013.01); *E04F 15/02405* (2013.01); *E04F 15/02452* (2013.01); *E04F 2015/02122* (2013.01); *E04F 2015/02127* (2013.01)

(58) Field of Classification Search
CPC ..... E04D 13/12; E04D 11/005; E04F 11/005; E04F 15/02044; E04F 15/02183; E04F 15/02405; E04F 15/02452; E04F 2015/02061; E04F 2015/02127; E04F 15/02464; E04F 2015/02122
See application file for complete search history.

(56) References Cited

U.S. PATENT DOCUMENTS 4,593,499 A * 6/1986 Kobayashi ..... E04F 15/0247 52/126.6
4,719,727 A * 1/1988 Cooper ..... B28B 1/20 52/126.1
4,922,670 A * 5/1990 Naka ..... E04F 15/02405 52/126.6
5,333,423 A * 8/1994 Propst ..... E04F 15/02476 248/188
5,459,968 A * 10/1995 Jin ..... E04F 15/02476 52/126.2
5,628,157 A * 5/1997 Chen ..... E04F 15/02458 52/220.2
6,101,768 A * 8/2000 Springstead ..... F24F 13/068 454/334
6,151,853 A * 11/2000 Fukunaga ..... E01C 5/00 52/264
6,189,289 B1 * 2/2001 Quaglia ..... E04F 15/024 52/126.4
6,256,952 B1 * 7/2001 Fahy, Jr. ..... E04B 9/02 52/126.6
6,564,514 B1 * 5/2003 Rickards ..... E04H 13/006 52/137
8,590,219 B2 * 11/2013 Meyer ..... E04F 15/02458 52/126.5
8,776,452 B1 * 7/2014 DeJonge ..... E04F 15/06 52/126.1
8,881,482 B2 * 11/2014 Cerny ..... E04F 15/02038 52/582.2
9,670,681 B2 * 6/2017 Buzon ..... E04F 15/02183
9,874,029 B2 * 1/2018 Kugler ..... E04F 15/02405
9,995,365 B1 * 6/2018 Kim-Whitty ..... E04F 15/06
10,570,626 B1 * 2/2020 Kim ..... E04F 15/02464
2002/0078638 A1 * 6/2002 Huang ..... E04B 5/10 52/126.6
2002/0144477 A1 * 10/2002 Chen ..... E04F 15/02476 52/263

(Continued)

*Primary Examiner* — Theodore V Adamos

(57) ABSTRACT

The present disclosure provides a paver lockdown system that prevents strong wind from uplifting pavers from pedestals installed on rooftops.

10 Claims, 12 Drawing Sheets

(56) References Cited

U.S. PATENT DOCUMENTS

| | | | | |
|---|---|---|---|---|
| 2003/0177723 | A1* | 9/2003 | Jakob-Bamberg | E04B 5/48 52/263 |
| 2004/0065028 | A1* | 4/2004 | Wu | E04F 15/02452 52/196 |
| 2004/0258473 | A1* | 12/2004 | Lin | F16B 5/0283 403/408.1 |
| 2005/0050818 | A1* | 3/2005 | Chen | E04F 15/02476 52/263 |
| 2005/0166483 | A1* | 8/2005 | Mead | E04F 15/02452 52/126.7 |
| 2008/0141601 | A1* | 6/2008 | Mead | E04F 15/02452 52/263 |
| 2009/0266010 | A1* | 10/2009 | Lomske | E04F 15/02044 52/173.1 |
| 2010/0000163 | A1* | 1/2010 | Tsai | E04F 15/02405 52/126.6 |
| 2011/0120037 | A1* | 5/2011 | Barlow | B44C 1/28 52/309.1 |
| 2013/0186015 | A1* | 7/2013 | Meyer | E04F 15/02405 52/126.5 |
| 2017/0138064 | A1* | 5/2017 | Kugler | E04F 15/02447 |
| 2017/0260750 | A1* | 9/2017 | Essig | E04F 15/02183 |
| 2018/0135311 | A1* | 5/2018 | Cipriani | E04F 15/02452 |
| 2018/0195293 | A1* | 7/2018 | Marchetti | E04F 15/02405 |
| 2019/0136547 | A1* | 5/2019 | Cataldi | E04F 15/02464 |

* cited by examiner

PAVER LOCKDOWN SYSTEMS AGAINST WIND UPLIFT THAT WORK WITH REGULAR PEDESTALS

RELATED APPLICATIONS

The present application claims priority to U.S. Provisional Patent Application No. 62/632,155, filed Feb. 19, 2018.

FIELD OF THE DISCLOSURE

The present disclosure provides a paver lockdown system that prevents strong wind from uplifting pavers from pedestals installed on rooftops.

BACKGROUND OF THE INVENTION

In the building construction industry, it is common to install pavers on roof tops to turn roof tops into useful spaces. The pavers are very often installed on plastic pedestals. The pedestals are used not only because they can be used to adjust the heights of the pavers to turn a sloped roof top to a leveled roof top, but also because they provide space between the pavers and the rooftop so pipes and wires can be laid beneath the pavers. In the past, there have been incidents when strong hurricane winds lifted pavers on roof tops and caused the pavers to fall from the rooftop to the streets. This is a serious threat to public safety. To solve this problem, several solutions have been offered.

One of the solutions offered is to glue the pavers down to the pedestals. However, since the pavers are glued to the pedestals, it would be impossible to lift the pavers if repair workers need to access the wires or pipes beneath the pavers.

Another solution offered is to leave screw holes on the corners of the pavers, and use screws to secure the pavers to the pedestals. This solves the safety problem and, at the same time, allows repair workers to easily remove the screws and lift the pavers if they need to access the wires and pipes beneath the pavers. However, the use of screw holes detracts from the aesthetic value of the whole installation. Even though the manufacturer provides caps to cover the screw holes, and the color of the caps are close to the color of pavers, the rows and columns of caps still destroy the beauty of the natural looking pavers. This is why many architects do not like this solution.

Yet another solution offered is to glue a piece of plastic plate to the bottom side of each corner of the paver. The plastic has a tab sticking out from the corner. A cross shaped plastic piece is used to hold down the four tabs from the four pavers on the same pedestal. The cross shaped plastic piece has a screw hole in the middle so a screw can be used to secure the cross shaped plastic piece to the center of the pedestal. The cross shaped plastic piece and the screw are inside the open joint between pavers. Therefore, this solution allows for easy removal of the pavers by unscrewing the screws, and it does not affect the look of the whole paver systems since screws are hidden inside the open joints. However, this solution also has a drawback. In this solution, the tabs on four pavers are all held down by one small screw. Since the open joint is usually 5 mm (3/16"), the diameter of the screw head needs to be less than 5 mm. This means the threads on the screw and on the inside surfaces of the screw holes in the plastic pedestal are very fine. The fine threads inside the plastic screw hole would not be strong enough to withstand the lifting force from the four pavers to prevent the strong hurricane wind from lifting the pavers.

The present disclosure provides a solution to address all the problems described above: it will lock down the pavers to the pedestals to prevent wind from lifting the pavers; there are no visible parts or screw holes that may affect the look of the paver installation; it is easy to use a simple tool such as a screw driver to unlock the pavers so repair workers can access the wires and pipes beneath the pavers; and it is much stronger and more reliable than the systems that rely on one small screw to hold down four pavers.

Exemplary embodiments in the present disclosure include the use of a 1.2-1.5 mm thick galvanized steel sheets. The galvanized steel sheets are glued to the back of the paver. Testing has shown that gluing 1.2 mm thick galvanized steel sheets to the back of the paver makes the paver very hard to break. And even when a paver installed on pedestal breaks, a person can still safely stand on top of the paver since the galvanized steel sheet is strong enough to support the weight of the person and prevent the broken paver and the person from falling of the pedestals. Therefore, the present invention not only provides safety against wind uplifting, but also provides additional safety against personal injury from possible paver breakage.

SUMMARY OF THE INVENTION

In accordance with the present invention, several exemplary paver lockdown systems are provided that work with existing plastic pedestals and provide ways to lock pavers down.

In one possible exemplary embodiment, a square or rectangular galvanized steel sheet with one securing tab on each of the four corners are glued to the back of the paver. The size of the galvanized steel sheet is equal to or slightly smaller than the size of the paver, with the four securing tabs sticking out of the paver by 5 mm or less. A metal lock that can be glued into an existing hole in the pedestal head is provided for each securing tab. The sliding bolt on the metal lock can be slid to a position above one of the tabs to lock down the tab and hence lock down the paver. And the sliding bolt can be slid away from the tab if the paver needs to be lifted so the repair workers can access the space below the paver.

In another exemplary embodiment, a sliding spacer with a base retained below the top surface of the pedestal are used. The base can slide below the top surface of the pedestal, which allows the sliding spacer to be slid to a position above one of the tabs to lock down the tab, or to be slid away from the tab if the paver needs to be lifted.

In yet another possible exemplary embodiment, a nut with a screw hole is glued into an existing hole on the pedestal head. A hole is provided on each tab of the galvanized steel sheet so a screw can go through the hole on the tab and be screwed into the screw hole on the nut, thus lock down the paver. The diameter of the screw head is 5 mm or less so it can go through the open space between pavers. The diameter of the screw head is larger than the hole on the tab, so when the screw is driven through the hole on the tab and into the screw hole on the nut, the tab is held down by the screw.

DETAILED DESCRIPTION OF THE INVENTION

The exemplary embodiments set forth below represent the information needed to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not explicitly addressed herein. It should be understood that these concepts and applications fall within the scope of the disclosure and the accompanying claims.

Figure 1:
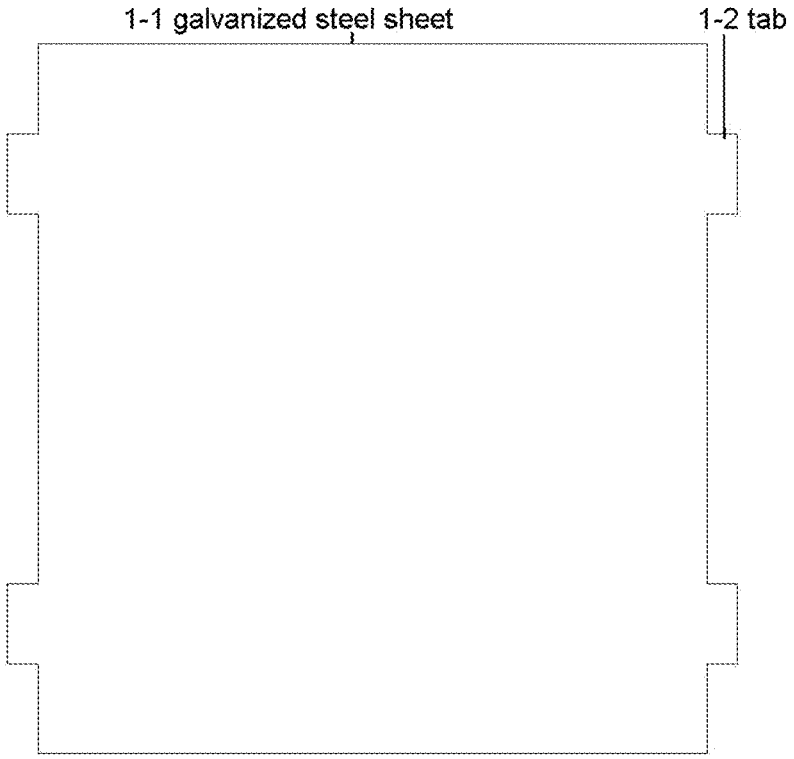
FIG. 1 is a galvanized steel sheet with four tabs.
Figure 2:
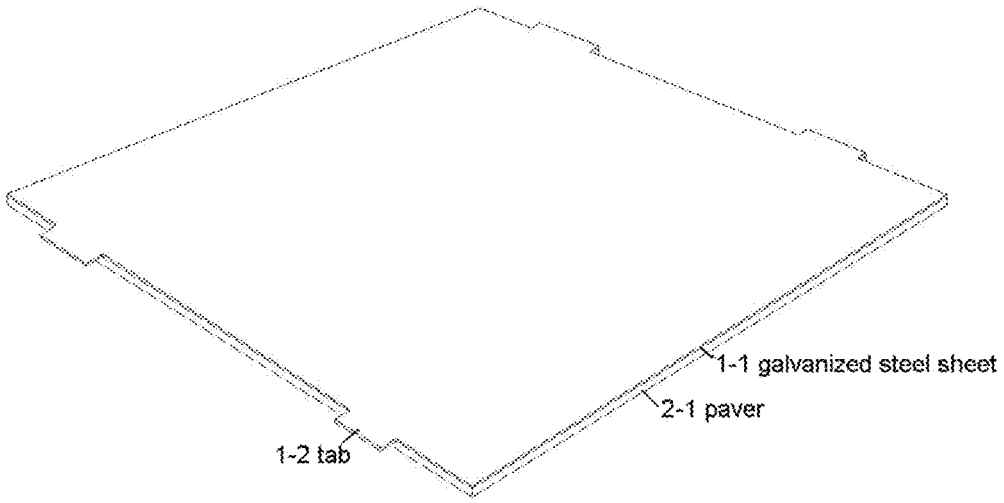
FIG. 2 shows that the galvanized steel sheet is glued to the back of a paver.
Figure 3:
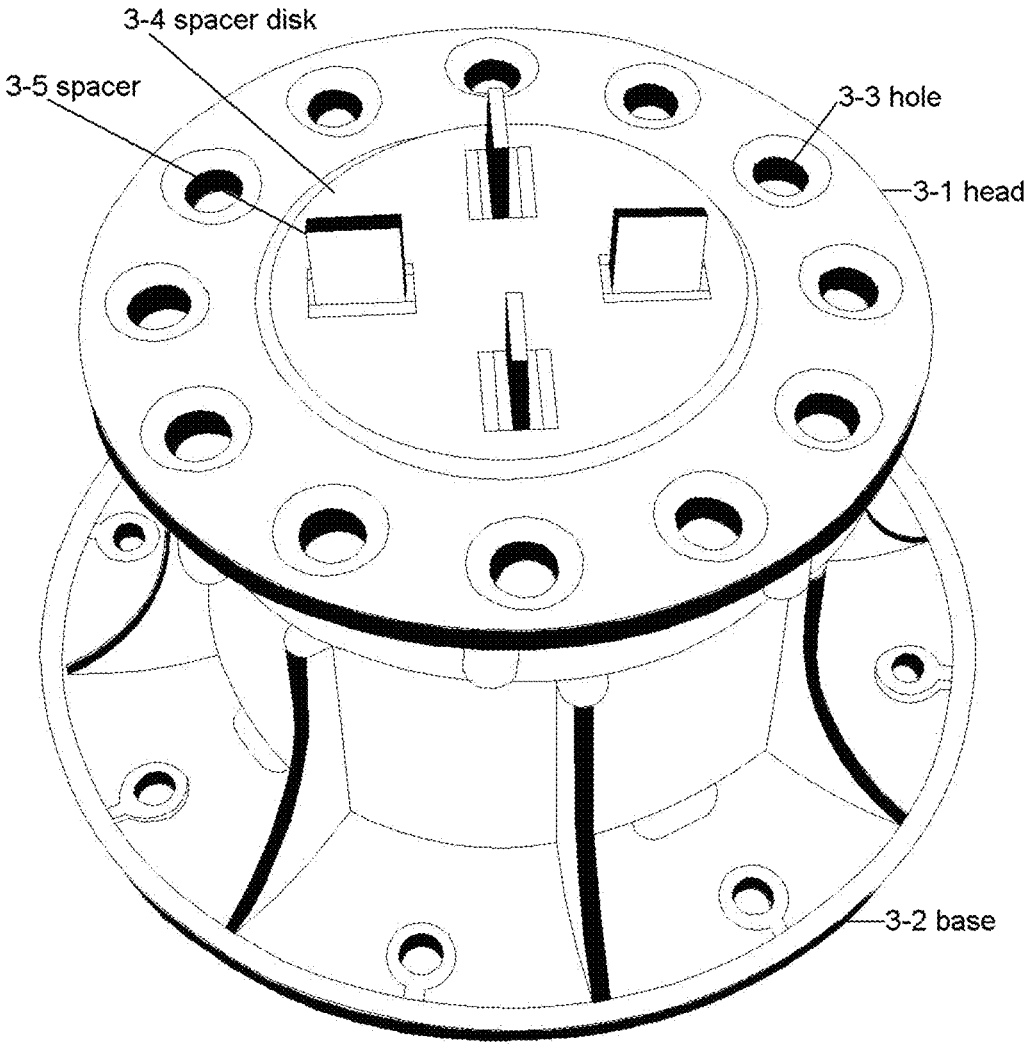
FIG. 3 is a plastic pedestal.
Figure 4:
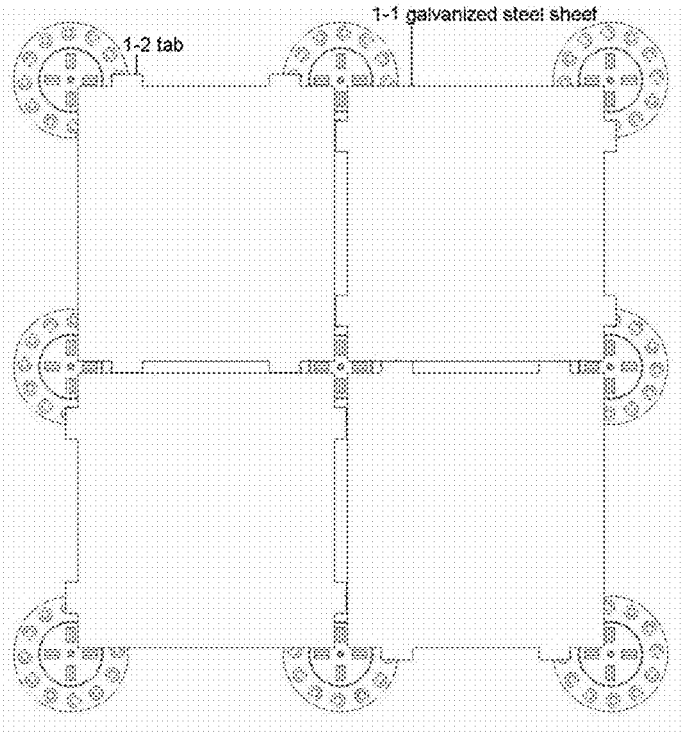
FIG. 4 shows four galvanized steel sheets, each with four tabs, placed on top of nine plastic pedestals.
Figure 5:
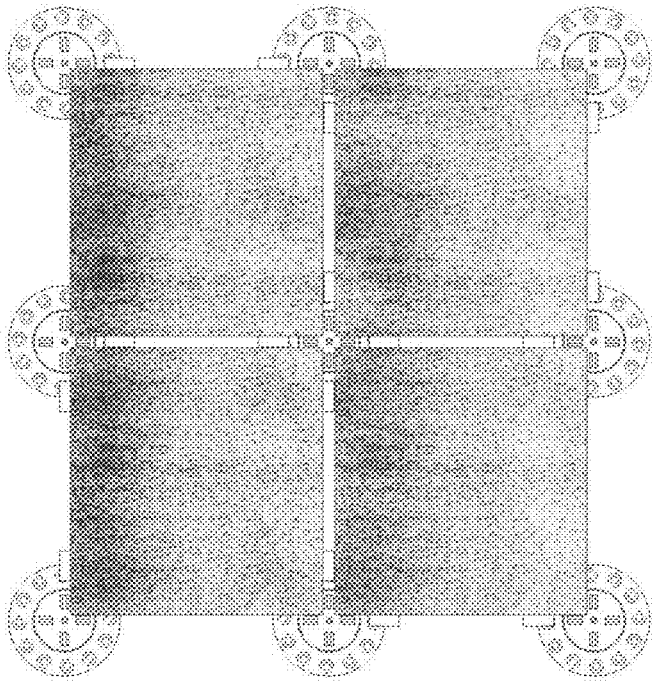
FIG. 5 shows four galvanized steel sheets, each with four tables, with four pavers glued to these four sheets, which are then placed on top of nine plastic pedestals.

In the present disclosure, three exemplary embodiments are provided. In all the three exemplary embodiments, a 1.2 mm thick rectangular (or square, depending on the shape of the paver) shaped galvanized steel sheet 1-1 is used, and the sheet has four tabs 1-2, as shown in FIG. 1. The sheet is 2-3 mm smaller than the paver on each side, which makes it easier to both glue the sheet to the back of the paver without getting excessive glue onto the side of the paver, and to use glue to cover the edges of the galvanized steel sheet to prevent the edges from rusting. Applying glue to the edges of the sheet is especially important when large galvanized steel sheets are cut into smaller sheets that fit the back of the paver, as the edges exposed by cutting are not protected by a galvanized layer. FIG. 2 shows a galvanized steel sheet glued to the back of a paver 2-1. Each tab 1-2 should stick out from the edge of the paver by 4 mm (assuming that the open space between pavers is 5/16"=5 mm). Pavers with galvanized steel sheets glued on the back are then installed on top of the plastic pedestal showing in FIG. 3. FIG. 4 shows the positions of each galvanized steel sheet on the pedestals. According to the FIG. 4, if a sheet is laid with two tabs on the top and two tabs on the bottom, then all the sheets next to it should have two tabs on the left and two tabs on the right. FIG. 5 shows that pavers are on top of the galvanized steel sheets with tabs sticking out of the edges of the pavers.

Figure 6:
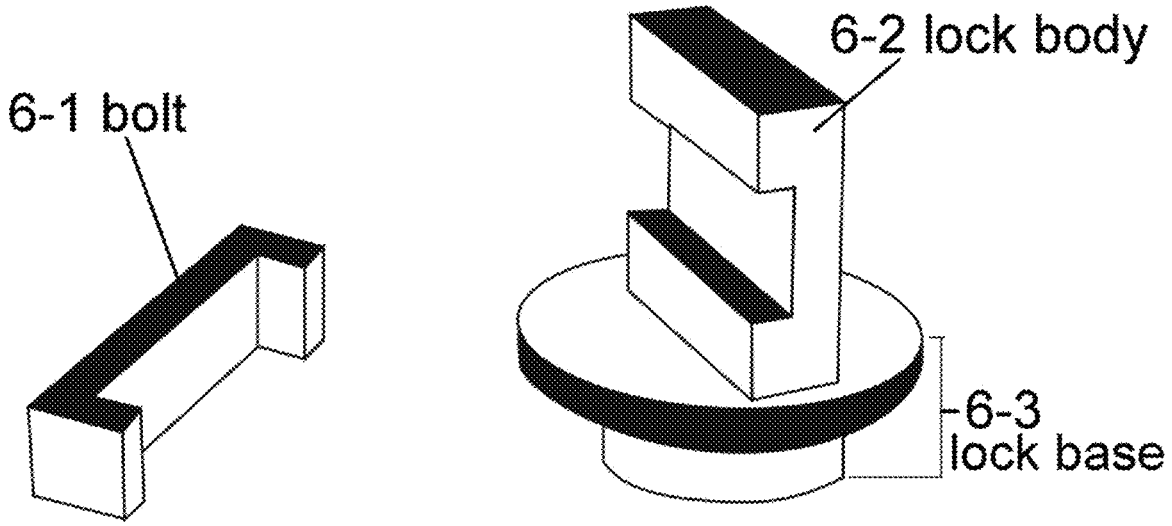
FIG. 6 is a metal lock assembly.
Figure 7:
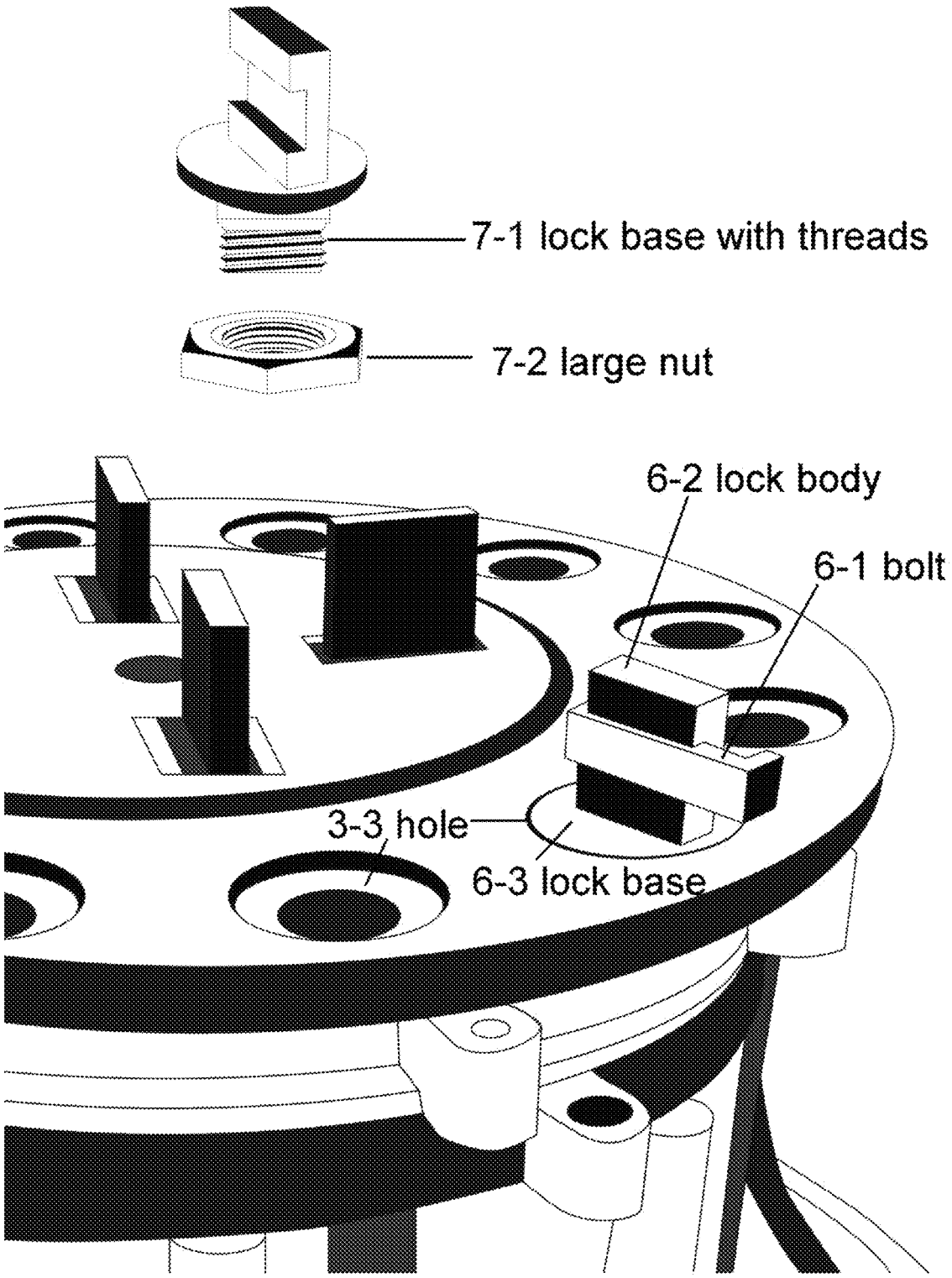
FIG. 7 shows the metal lock assembly glued into a hole on the pedestal head.

In the first exemplary embodiment, a metal lock is provided, as shown in FIG. 6. The metal lock assembly includes a lock body 6-2 which includes a lock base 6-3. The lock base fits into the hole 3-3 in a plastic pedestal. The metal lock assembly also includes a sliding bolt 6-1. FIG. 7 shows how the sliding bolt 6-1 fits into the lock body 6-2. The lock base 6-3 has been glued into the hole 3-3 in FIG. 7. Note that the sliding bolt will not fall off the lock body since the sliding bolt and the lock body will be in the tight open space between two pavers.

One alternative for the lock base is to make it longer with threads 7-1 on the bottom half of the lock base. Once the lock base is place into the hole 3-3, a large nut 7-2 can be tighten onto the threads 7-1 from the bottom side of the hole 3-3. This alternative is more secure than gluing the lock base to the hole 3-3. But gluing the lock base to the hole 3-3 is easier and requires less labor.

Some plastic pedestals do not have holes on the head 3-1. In that case, the metal lock can be made without lock base 6-3, and can be glued onto the surface of the head 3-1 directly. Please also note that one can make a head 3-1 that already comes with a plastic lock body 6-2 and a plastic sliding bolt 6-1.

Figure 8:
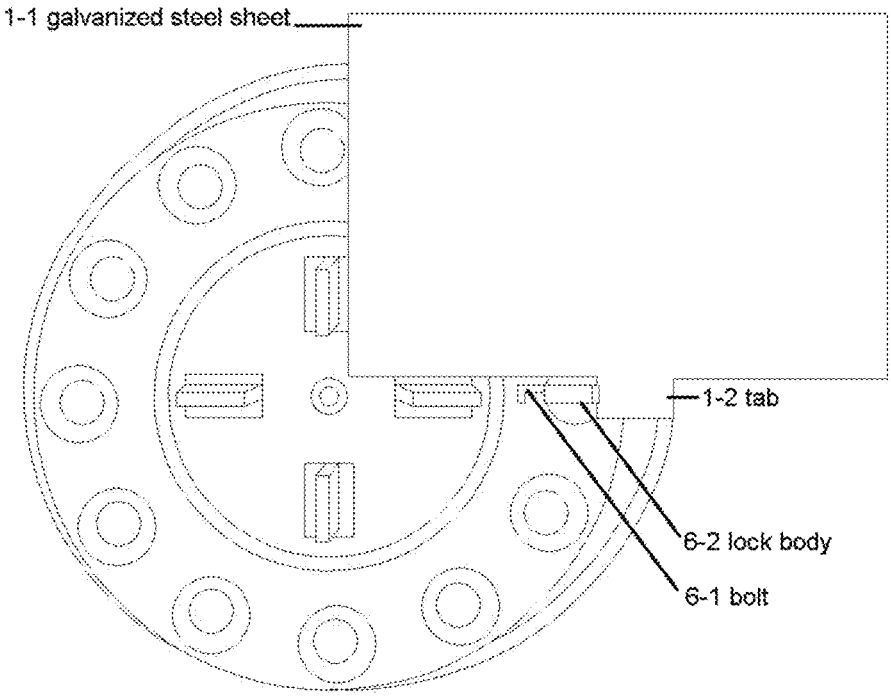
FIG. 8 shows the metal lock next to a tab of a galvanized steel sheet and the sliding bolt away from the tab.
Figure 9:
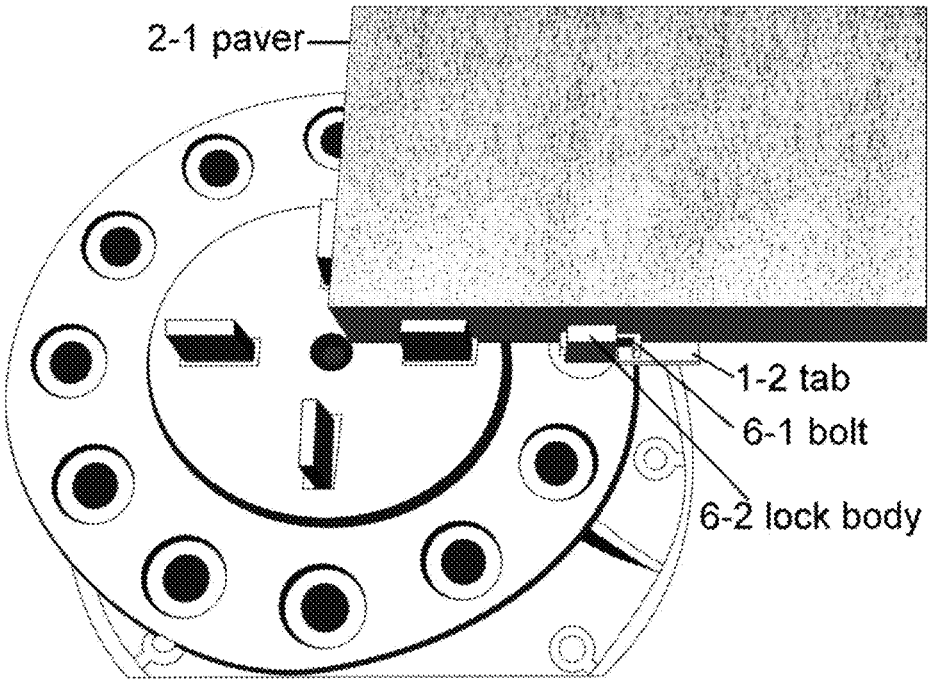
FIG. 9 shows the metal lock next to a tab of a galvanized steel sheet, a paver glued to the galvanized steel sheet, and the sliding bolt on top of the tab.
Figure 10:
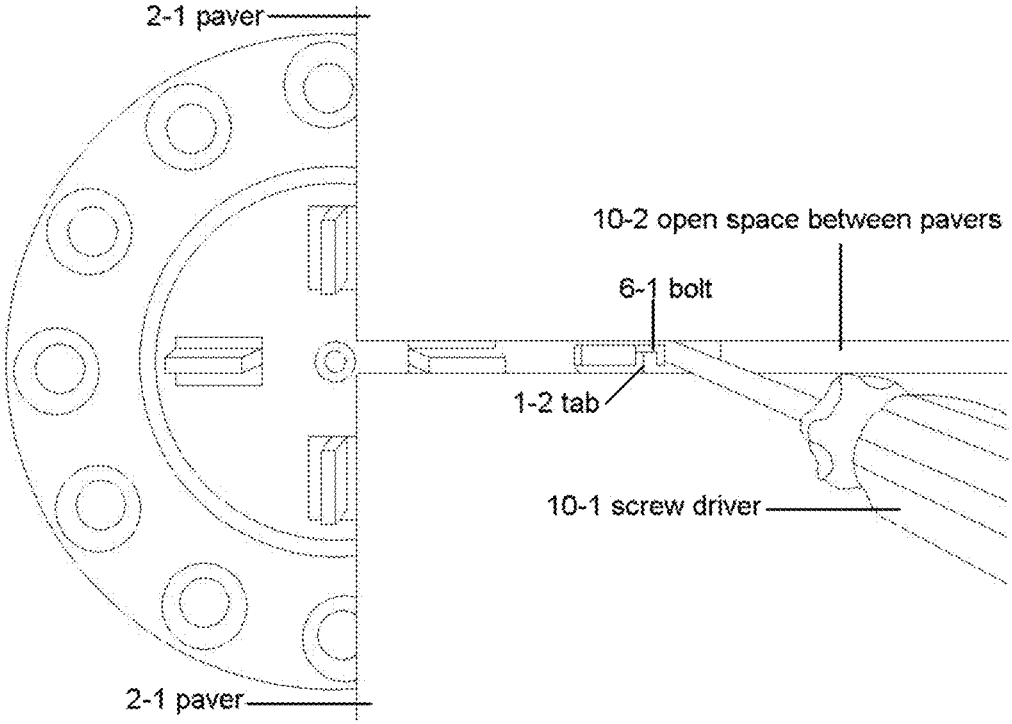
FIG. 10 shows that a screw driver can be used to push the sliding bolt away from the tab to unlock it, or to push the sliding bolt to the position above the tab to lock it.

FIG. 8 shows a lock body 6-2 next to a tab 1-2, with the sliding bolt 6-1 away from tab. This is called an "unlock position" since the sliding bolt is not on top of the tab to lock it down. FIG. 9 shows that a paver has already been glued to the galvanized steel sheet, and the sliding bolt 6-1 is on top of the tab 1-2. This is called a "lock position", because the sliding bolt on top of the tab locks down the tab in place, preventing the paver from being lifted from the pedestal. FIG. 10 shows that a screw driver 10-1 can be used to go into the open space 10-2 to push the sliding bolt 6-1 into a "lock position" or "unlock position".

Note that once pedestals are glued to the roof top and all the sliding bolts are in "lock position", the pavers cannot be removed from the pedestals, which then prevents strong winds from uplifting the pavers. If any paver needs to be removed to repair the wires or pipes below the pavers, a repair person can easily use a screw driver to push all the four sliding bolts that are locking the four tabs of this paver to the "unlock position", which allows the paver to be easily lifted up from the pedestals.

Figure 11:
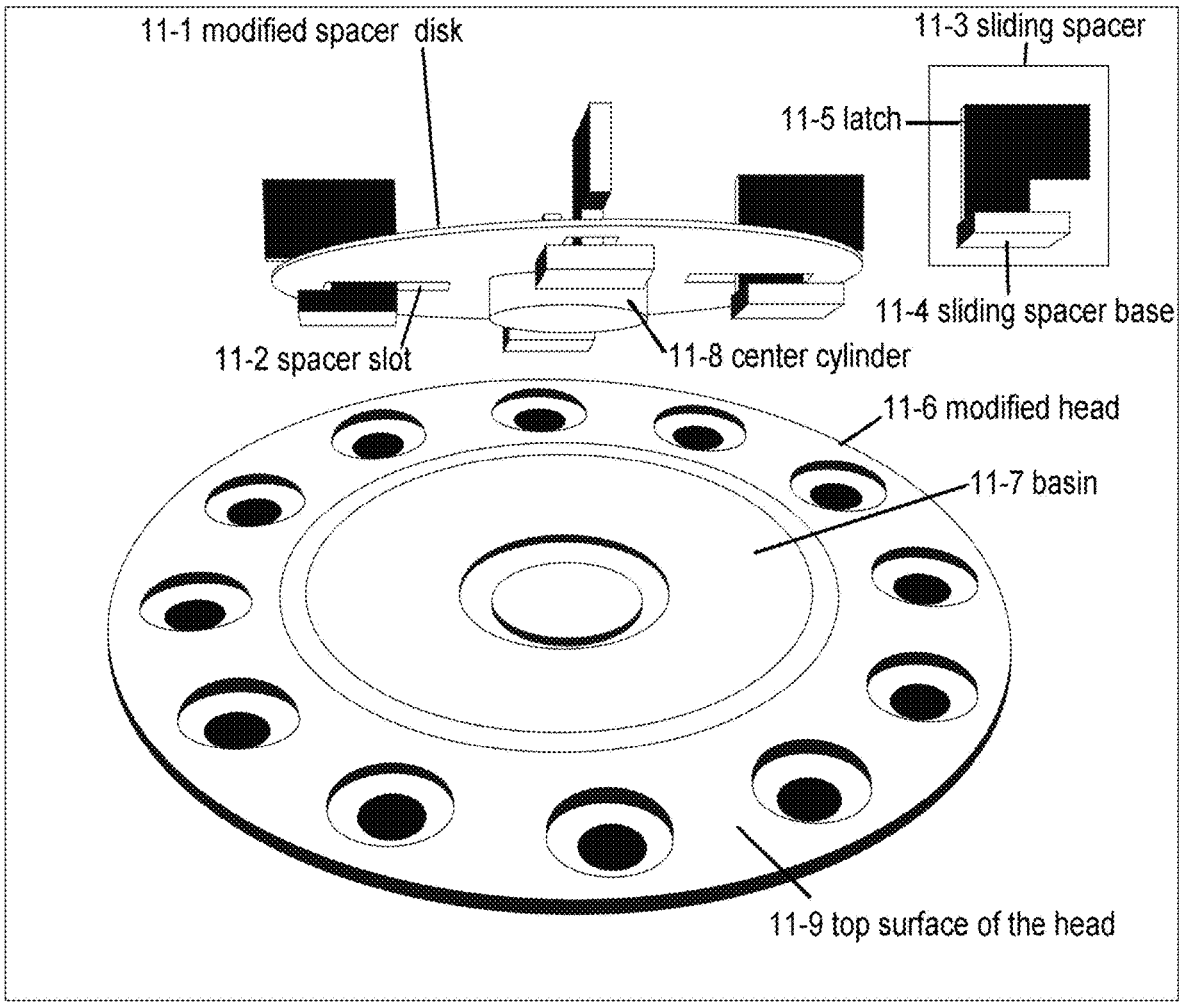
FIG. 11 shows a sliding spacer that can be used to lock or unlock the tab.

In the second exemplary embodiment as shown in FIG. 11, a modified spacer disk 11-1 and a modified head 11-6 are provided. The modified spacer disk 11-1 can be obtained by taking a regular spacer disk 3-4 and pulling the four spacers 3-5 off from the disk. Note that most of the spacers are designed so that they can be easily pulled off. This feature is useful in the event that the pedestal is used along the edges of the paver installation, or in case that installers want to place pedestals underneath the center of pavers for added safety. When a spacer is pulled off, it leaves a rectangular slot 11-2, which is called a "spacer slot". A sliding spacer 11-3 is provided, which consists of a latch 11-5 that looks like an upside down L, and a flat base 11-4, which is called a sliding spacer base. The sliding spacers are assembled to the spacer disk by putting the latch 11-5 through the spacer slot 11-2 from the bottom of the modified spacer disk 11-1. The modified spacer disk with the sliding spacers assembled is placed into the basin 11-7 of the modified head 11-6, and the center cylinder 11-8 is glued to the basin 11-7. The sliding spacer base 11-4 must be wider than the width of the spacer slot 11-2 so the sliding spacer 11-3 cannot not be pulled away from the pedestal from above. Note that the modified head 11-6 is modified to have a basin 11-7 that is deep enough, so that even with the sliding spacer base 11-4 added to the bottom of the modified spacer disk 11-1, the top surface of the modified spacer disk 11-1 is still lower than the top surface 11-9 of the modified head 11-6. This ensures that the weight of the pavers is placed on the top surface 11-9 of the modified head 11-6, not on the top surface of the spacer disk 11-1. Otherwise, if the weight of the pavers is placed on the top surface of the spacer disk 11-1, it will push down on the sliding spacer base and make it impossible for the sliding spacer to move.

Figure 12:
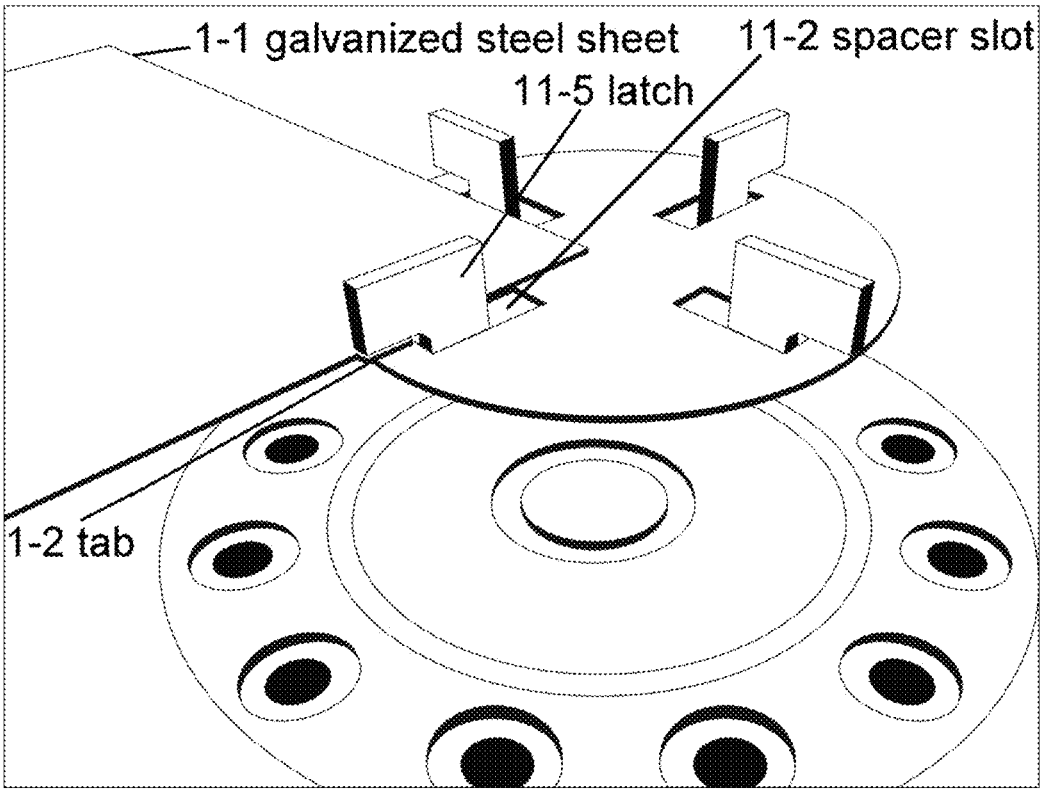
FIG. 12 shows the sliding spacer locking the tab.

FIG. 12 shows that the latch 11-5 is moved onto the top of the tab 1-2, and locks down the galvanized steel sheet 1-1. Note that latch 11-5 is inside the open space 10-2 between two pavers. A screw driver can be used to move the latch to lock or unlock the galvanized steel sheet.

Figure 13:
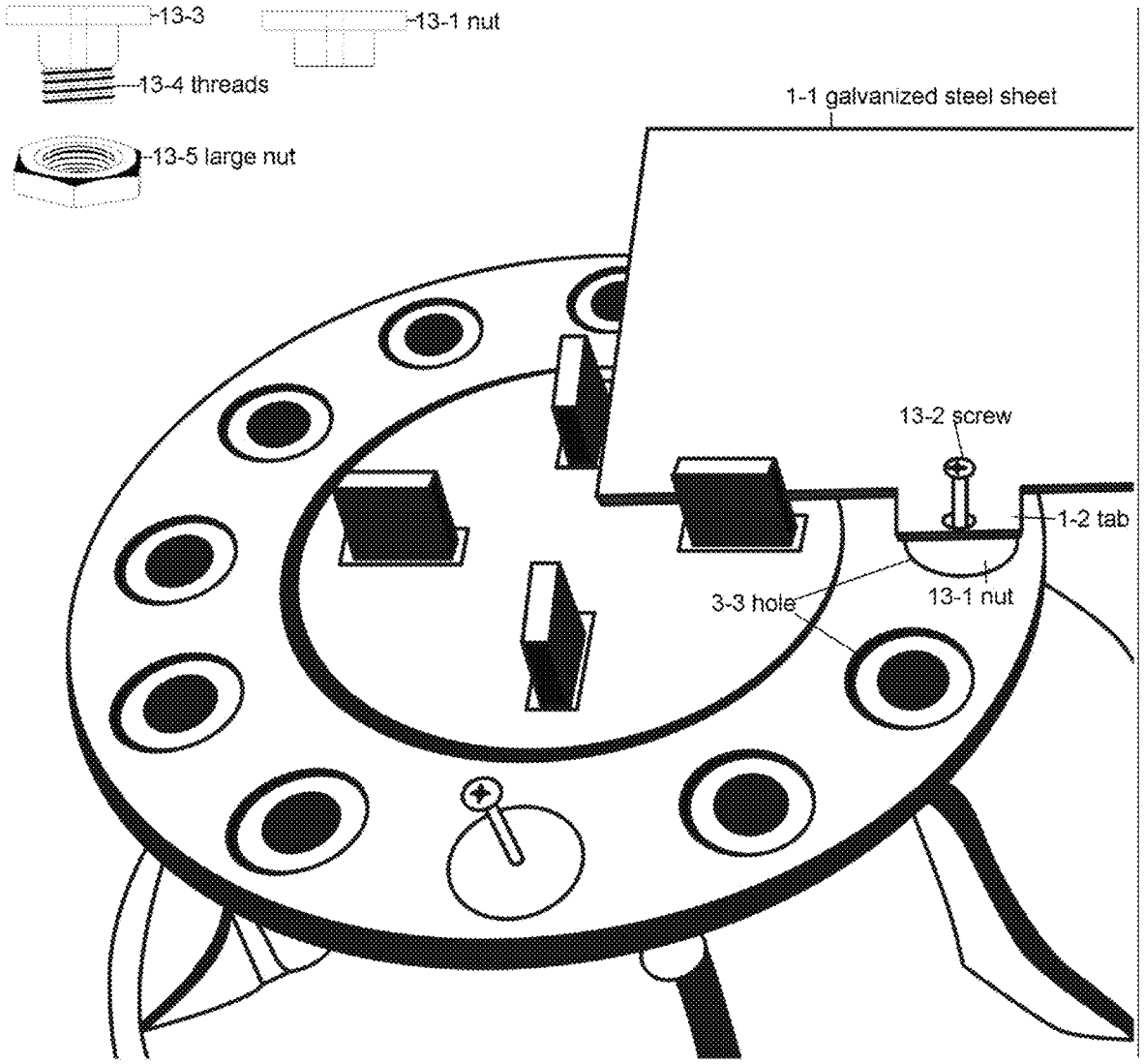
FIG. 13 shows a screw being used to lock the tab.

In the third exemplary embodiment as shown on FIG. 13, a nut 13-1 which fits the existing hole 3-3 on the pedestal head is provided. The nut has a screw hole in the center. A hole in the center of the tab 1-2 is provided so a screw 13-2 can be used to secure the tab to the nut 13-1. Note that the hole in the center of the tab 1-2 can be made into an oval shape that is much larger than the diameter of the screw for easy installation. A washer can be used the cover this large oval hole if it is needed. The screw 13-2 locks the tab in place which prevents the paver glued to the galvanized steel sheet 1-1 from being removed. The screw 13-2 is hidden in the open space 10-2 between two pavers and can be accessed with a screw driver. The nut 13-1 is glued into the hole 3-3.

Alternatively, the nut 13-1 can be modified into 13-3, which has threads 13-4 on the bottom. Another larger nut 13-5 is tighten onto the threads 13-4 from the bottom side of the hole 3-3. Using the bolt 13-3 and the large nut 13-5 eliminates the need for glue and is more secure. But using bolt 13-1 with glue is easier for installation.

Each of the exemplary embodiment described above is only one possible exemplary embodiment. Other embodiments can be derived from the exemplary embodiments described. For example, stainless steel sheets or plastic grids can be used to replace the galvanized steel sheet.

Figure 14:
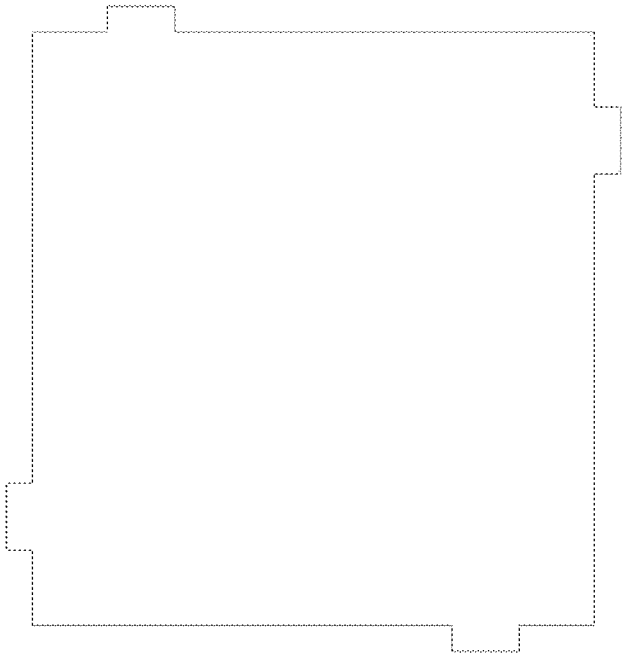
FIG. 14 shows an alternative way to arrange the position of the four tabs on the galvanized steel sheet.
Figure 15:
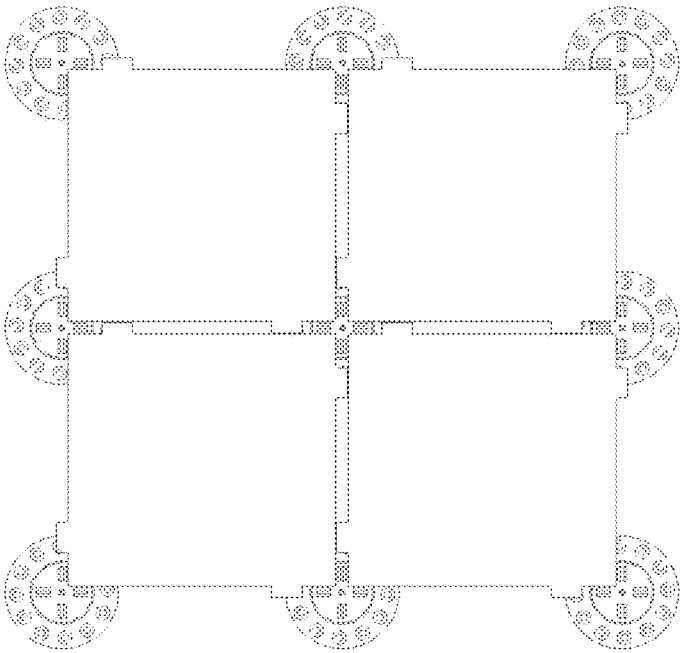
FIG. 15 shows how the galvanized steel sheets should be arranged during installation if the alternative arrangement of tab positions is used.

The four tabs on the galvanized steel sheet can be arranged differently from the arrangement in FIG. 1. An example of a different arrangement is shown on FIG. 14 and FIG. 15.

Figure 16:
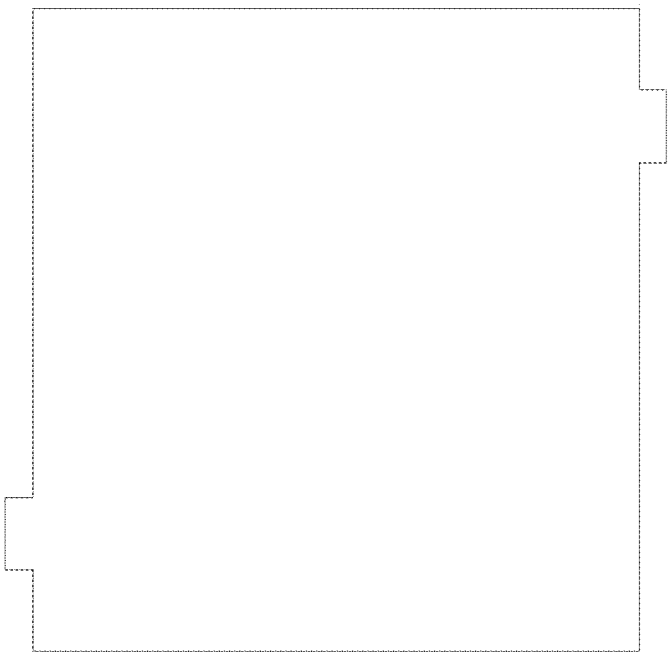
FIG. 16 shows that instead of four tabs, two tabs can be used.

Additionally, instead of having four tabs on each galvanized steel sheet, having two tabs on each sheet located in diagonally opposite positions would also allow the galvanized steel sheet to be secured on the pedestals. See FIG. 16.

Gluing 1.2 mm galvanized steel sheet to the back of the paver not only provides a way to lock down the paver to pedestals to prevent wind from uplifting the paver, but also provides additional safety. Tests showed that even when the paver is broken, the galvanized steel sheet is strong enough for a person to stand on the broken paver without falling down from pedestals. 1.5 mm thick perforated galvanized steel sheet was also tested. Again, with the perforated galvanized steel sheet glued to the back of the paver, and after the paver is broken by a hammer, a person can still safely stand on top of the broken paver that sits on top of four pedestals.

If a user feels that the added safety of gluing a large galvanized steel sheet to the back of the paver is not needed, four smaller pieces of galvanized steel sheet, each with a tab, can be glued to four corners of the paver. For example, with a 24"×24" paver, four 2"×2" galvanized steel sheets, each with one tab, can be glued to the back of the paver with the tabs sticking out of the edges of the pavers by 4 mm.

Although no detailed mechanical drawings or detailed assembly instructions are given in the above description, the apparatus described above is clear enough, and a person skilled in the field should be able to design and manufacture the apparatus according to the description.

What is claimed is:

1. An apparatus for locking down pavers to pedestals to prevent pavers from being lifted by wind, and for allowing pavers to be easily removed from pedestals when necessary, the apparatus comprising:

a. a paver and a solid sheet that is glued to a back surface of the paver, where the solid sheet comprises at least two tabs, with at least one tab of the at least two tabs provided on at least two peripheral edges of the solid sheet, and said at least two tabs extend beyond peripheral edges of the paver, wherein the at least two tabs are formed as a single piece of material with the solid sheet and are configured to space the paver from adjacent pavers when in an installed state;

b. a mechanism for each tab, where each mechanism is either attached to a respective pedestal, or is built as a part of the respective pedestal, the solid sheet resting on each pedestal and where each mechanism either comprises a screw and a screw hole to allow a respective tab to be screwed down by the screw to the respective pedestal, or each mechanism comprises a part that can be moved relative to the respective pedestal to a position on top of the respective tab in order to lock down the respective tab in a vertical direction and can be moved away from the respective tab in order to unlock the respective tab.

2. The apparatus according to claim 1, wherein each mechanism is a lock which consists of a lock body that is attached to the respective pedestal, and a sliding bolt that can be moved to the position on top of the respective tab in order to lock down the solid sheet and can be moved away from the respective tab in order to unlock the solid sheet.

3. The apparatus according to claim 1, wherein each mechanism consists of:

a modified spacer disk, which has slots that allow a sliding spacer to move back and forth;

at least one sliding spacer, which consists of a base that is wider than a width of the slots and stays beneath the modified spacer disk, and a latch attached to the base, the latch can be moved to the position on top of the respective tab in order to lock down the solid sheet and can be moved away from the respective tab in order to unlock the solid sheet.

4. The apparatus according to claim 1, wherein the solid sheet is galvanized steel sheet.

5. The apparatus according to claim 1, wherein the solid sheet is a stainless steel sheet.

6. The apparatus according to claim 1, wherein the solid sheet is a plastic grid.

7. The apparatus according to claim 1, wherein each mechanism contains the screw hole, and the respective tab has a hole or an opening that allows the screw to go through the hole or opening of the respective tab and go into the screw hole to secure the respective tab onto the respective pedestal.

8. The apparatus according to claim 7, wherein the solid sheet is a galvanized steel sheet.

9. The apparatus according to claim 7, wherein the solid sheet is a stainless steel sheet.

10. The apparatus according to claim 7, wherein the solid sheet is a plastic grid.

* * * * *